United States Patent [19]

Vollers

[11] 4,315,462

[45] Feb. 16, 1982

[54] SHOT GUN SHELL PRIMER

[76] Inventor: Gary L. Vollers, 11471 Tampa Ave., No. 149, Northridge, Calif. 91336

[21] Appl. No.: 73,950

[22] Filed: Sep. 10, 1979

[51] Int. Cl.[3] ..... F42C 19/10

[52] U.S. Cl. ..... 102/204; 102/470

[58] Field of Search ..... 102/204, 45, 44, 43 P

[56] References Cited

U.S. PATENT DOCUMENTS

| | | | |
|---|---|---|---|
| 733,638 | 7/1903 | Gardner | 102/204 |
| 1,438,779 | 12/1922 | Olin | 102/45 |
| 1,541,437 | 6/1925 | Schauerte et al. | 102/45 |
| 2,068,516 | 1/1937 | Seavey | 102/204 |
| 3,195,463 | 7/1965 | Foote et al. | 102/45 |
| 3,236,181 | 2/1966 | Woodring et al. | 102/45 |
| 3,363,563 | 1/1968 | Eckstein | 102/45 |
| 3,516,357 | 6/1970 | Hendricks | 102/45 |
| 3,529,548 | 9/1970 | Gawlick et al. | 102/45 |
| 3,732,820 | 5/1973 | Hendricks | 102/45 |
| 3,786,755 | 1/1974 | Eckstein et al. | 102/45 |

*Primary Examiner*—Charles T. Jordan

*Attorney, Agent, or Firm*—William W. Haefliger

[57] ABSTRACT

A primer assembly for a shot gun shell, comprises, (a) a one-piece unitary plastic outer cup defining an axis and having a cylindrical side wall and a bottom wall, (b) and a plastic anvil plate extending in an axial radial plane transversely within and crosswise of the cup interior, the plate having an anvil tip facing toward the mouth of the cup, (c) the anvil plate being integral with the cup side wall and bottom wall so that the plate and cup have one-piece unitary construction.

7 Claims, 4 Drawing Figures

SHOT GUN SHELL PRIMER

BACKGROUND OF THE INVENTION

This invention relates generally to the construction of shot gun shell primer assemblies, and more particularly concerns an all plastic assembly, of fewer parts than are needed in conventional primers.

Considering the vast numbers of shot gun shells that are used, there is a constant need for improvements in such shells, as for example simplifications in shell construction and assembly, leading to lower cost. That need is met by the present invention, which eliminates several steps in assembly of such primers and shells through elimination of metal parts and their insertion in sub-assemblies.

SUMMARY OF THE INVENTION

It is a major object of the present invention to provide a primer cup and battery cup sub-assembly of unusually simple construction, as well as facilitating use of that sub-assembly in a plastic shot gun shell casing. Basically, the invention is embodied in:

(a) a one-piece unitary plastic outer cup defining an axis and having a cylindrical side wall and a bottom wall, (b) and a plastic anvil plate extending in an axial radial plane transversely within and crosswise of the cup interior, the plate tapering toward the mouth of the cup, (c) the anvil plate being integral with the cup side wall and the bottom wall so that the plate and cup have one-piece unitary construction. As will be seen an inner plastic cup (i.e. battery cup) telescopically interfits the outer cup (or primer cup) to provide a flexible, hermetic seal therebetween, and the outer cup and anvil plate provide a means to limit insertion of the battery cup so that a precision gap is provided between a tip or hump defined by the anvil plate and a layer of detonatable primer composition carried on the bottom wall of the battery cup, facilitating detonation of the composition, without malfunction, when that bottom wall is struck by a firing pin. Therefore, no separate metallic anvil ball is required.

Typically, an edge of the anvil plate integral with the outer cup provides a land to limit such insertion of the battery cup into the primer cup. Also, the construction facilitates formation of an all-plastic, flexible seal (hermetic) between the outer cup and a boss defined by the shot gun shell, as will be seen. Finally, the use of plastic facilitates molding of a thin "skin" or layer over the flash hole at the bottom of the primer cup, which prevents entry of powder, moisture and other substances from the shell into the primer cup.

These and other objects and advantages of the invention, as well as the details of an illustrative embodiment, will be more fully understood from the following description and drawings in which:

DRAWING DESCRIPTION

Figure 2:
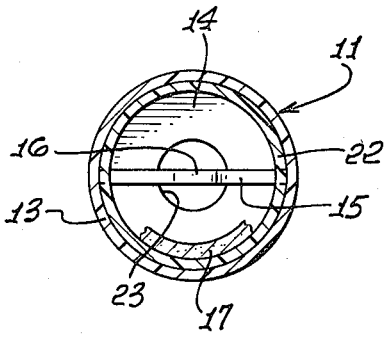
FIG. 2 is a plan view on lines 2—2 of FIG. 1.
Figure 2A:
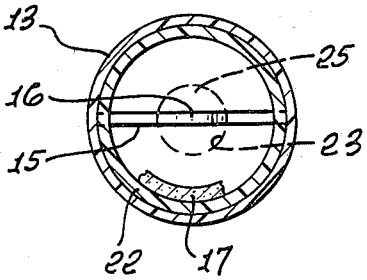

FIG. 2*a* is a view like FIG. 2, but showing a modification; and

Figure 3:
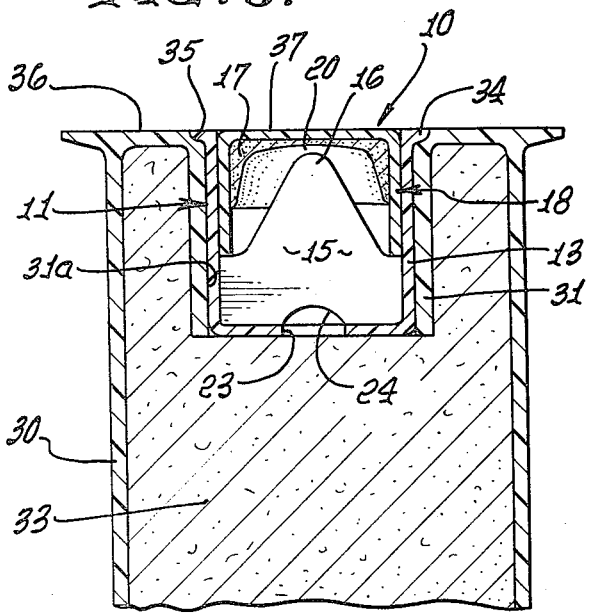

FIG. 3 is a view showing the battery cup and primer cup combination assembled to a shot gun shell.

DETAILED DESCRIPTION

Figure 1:
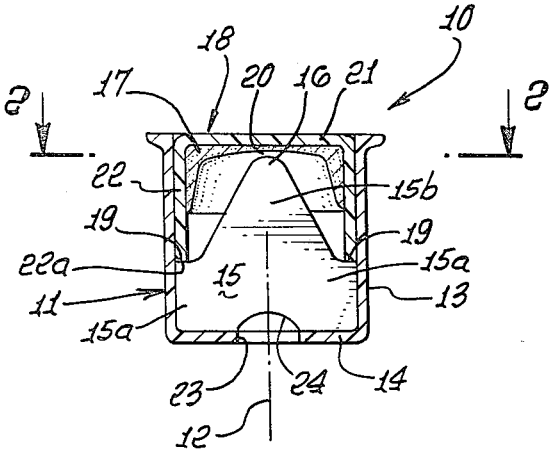
FIG. 1 is a vertical section through a primer cup and battery cup in assembled condition.

In FIGS. 1 and 2, a primer assembly 10 for a shot gun shell includes a one-piece unitary plastic outer cup (i.e. a primer cup) 11 defining a central axis 12. The cup has a cylindrical side wall 13 and a bottom wall 14, these being integral and the cup consisting of injection molded plastic material, preferably a polyacetal thermoplastic material such as DELRIN (a product of E. I. DuPont de Nemours) or CELON, (a product of Celenese Corporation).

Integrally molded with the cup is a plastic anvil plate 15 that extends in an axial radial plane, transversely within and crosswise of the cup interior. The plate 15 has lower opposite portions 15*a* integrally joined to wall 13, and an upper portion 15*b* that tapers axially upwardly in FIG. 1, toward the cup mouth. At the apex of the plate is formed a central hump 16 of small radius, i.e. about 1/16 inch. Hump 16 is one form of plate tip. The hump surface is sufficiently hard to act as an anvil to ignite the priming composition designated at 17 and carried within the battery cup 18, to be described, whereby no separate metallic anvil ball is required. Accordingly, the anvil plate and cap 11 have one-piece, unitary construction, whereby the hump 16 surface is always at a fixed distance from lands 19 formed by the anvil plate. As will be seen this contributes to establishment of a fixed, predetermined slight gap 20 between the hump and the priming composition 17, which assures detonation of the composition 17 when the bottom wall 21 of battery cup 18 is struck by a firing pin. Gap 20 is typically between 0.005 and 0.015 inches, and the anvil plate 15 may have a thickness of about 0.030 inches. The hump may alternatively be formed on wall 21 to face the anvil plate tip.

The battery cup 18 is also a precision injection molded plastic part, and may consist of DELRIN, for example. Cup 18 has a cylindrical side wall or skirt 22 sized to have sealing telescopic interfit with the bore of primer cup wall 13, whereby a hermetic seal is established therebetween. At the same time, the seal is flexible due to the plastic construction. The rim 22*a* of wall 22 seats on one or both lands 19 to limit the telescopic assembly of the cups, whereby the accurate gap 20 is established, that gap being repeated for all units being mass produced. In this regard, detonatable primer composition 17 extends in a fixed thickness layer across the inner side of the bottom wall 21 of cup 18.

It will be appreciated that the integral molding of the anvil plate 15 and the outer cup 13 eliminates need for separate insertion of the anvil into the other cup, as was necessary in prior metal units; also need for inspection is eliminated.

FIG. 3 shows the sub-assembly 10 of FIG. 1 assembled to a shot gun shell 30. As seen, the shell has an internal or re-entrant cylindrical boss 31 to the bore 31*a* of which the sub-assembly 10 is telescopically assembled, i.e. wall 13 has flexible sealing telescopic interfit with bore 31*a*. The shell is also molded of plastic material such as high density polyethylene, whereby an inexpensive all plastic shot gun shell assembly is provided. Powder is shown at 33. A rim flange 34 on the cup 11 interfits the shell wall at annular recess 35, whereby the rear face 36 of the shell is flush (or approximately flush) with the outer surface 37 of battery cup wall 21.

The bottom wall 14 of the primer cup forms a central "flash opening" 23, and the anvil plate 15 is upwardly recessed at 24, above that opening. This facilitates good communication of the detonation flash to powder in the shot gun shell to be described. FIG. 2*a* shows a modification wherein a thin layer 25 of "skin" of plastic, integral with the cup 11 and anvil 15, covers the flash hole 23, to prevent powder from within the shot gun shell from entering into the interior of the primer cup and possibly gaining access to gap 20. Layer 25 is dome shaped, i.e. has the contour of recess 24.

I claim:

1. In a primer assembly for a shot gun shell, (a) a one-piece unitary plastic outer cup defining an axis and having a cylindrical side wall and a bottom wall, (b) and a plastic anvil plate extending in an axial radial plane transversely within and crosswise of the cup interior, the plate having an anvil tip facing toward the mouth of the cup, (c) the anvil plate being integral with the cup side wall and bottom wall so that the plate and cup have one-piece unitary construction, (d) the assembly including an inner plastic cup telescopically interfitting the outer cup, the inner cup having a bottom wall extending crosswise of the mouth of the outer cup and in spaced relation to the anvil tip defined by the anvil plate whereby detonatable primer mix may be introduced into the inner cup and between the bottom wall of the inner cup and said plate, (e) the assembly including a flash hole formed in the outer cup bottom wall, in alignment with the anvil plate, (f) there being a thin layer of plastic material covering the flash hole, said layer being integral with said plate and bottom wall to be ruptured in response to detonation of the primer mix,.

(g) the outer cup, anvil plate and thin layer covering the flash hole being of one-piece molded construction, said plate directly and integrally joined to said cup side wall and bottom wall at locations radially outwardly spaced from said thin plastic layer.

2. The primer assembly of claim 1 wherein the inner cup has a side wall assembled to the side wall of the outer cup to form a flexible seal therebetween.

3. The primer assembly of claim 3 wherein one of the two cups has at least one land facing and engaging a rim defined by the side wall of the inner cup to limit telescopic insertion of the inner cup into the outer cup, the anvil plate consisting of polyacetal.

4. The primer assembly of claim 3 wherein said land is defined by an edge of the plate.

5. The primer assembly of claim 3 wherein said land protrudes inwardly from the wall of the outer cup.

6. The primer assembly of claim 1 including said shot gun shell having an internal cylindrical boss to which said outer cup is telescopically assembled.

7. The primer assembly of claim 6 wherein said boss is plastic, and said boss and said wall of the outer cup define a flexible plastic seal.

* * * * *